US006416921B1

(12) United States Patent
Wilson et al.

(10) Patent No.: US 6,416,921 B1
(45) **Date of Patent: *Jul. 9, 2002**

(54) METHOD FOR FORMING TONER PARTICLES HAVING CONTROLLED MORPHOLOGY AND CONTAINING A QUATERNARY AMMONIUM TETRAPHENYLBORATE AND A POLYMERIC PHOSPHONIUM SALT

(75) Inventors: John C. Wilson, Rochester; Matthew C. Ezenyilimba, Walworth; Gretchen S. McGrath, Rochester, all of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/814,923

(22) Filed: Mar. 22, 2001

(51) Int. Cl.[7] ..... G03G 9/08
(52) U.S. Cl. ..... 430/137.14; 523/339
(58) Field of Search ..... 430/137.14, 137.1; 523/339

(56) References Cited

U.S. PATENT DOCUMENTS

| | | | | |
|---|---|---|---|---|
| 4,833,060 | A | | 5/1989 | Nair et al. |
| 4,837,394 | A | | 6/1989 | Alexandrovich et al. |
| 4,855,376 | A | | 8/1989 | Wilson et al. |
| 4,965,131 | A | | 10/1990 | Nair et al. |
| 5,041,625 | A | | 8/1991 | Wilson et al. |
| 5,075,190 | A | | 12/1991 | Alexandrovich et al. |
| 5,194,472 | A | | 3/1993 | Wilson et al. |
| 5,283,151 | A | | 2/1994 | Santilli |
| 5,482,741 | A | | 1/1996 | Law et al. |
| 5,516,616 | A | | 5/1996 | Wilson et al. |
| 5,968,702 | A | * | 10/1999 | Ezenyilimba et al. .. 430/137.14 |
| 2001/0018474 | A1 | * | 8/2001 | Sorriero et al. ..... 523/501 |

OTHER PUBLICATIONS

CAPLUS Abstract AN1993: 202010, (1993), English Language Abstract of JP 91–41021.

* cited by examiner

*Primary Examiner*—Christopher Rodee
(74) *Attorney, Agent, or Firm*—Jaeckle Fleischmann & Mugel, LLP

(57) ABSTRACT

A process for forming non-spherical toner particles by limited coalescence comprises: forming an organic phase comprising a polymeric material, a pigment, a quaternary ammonium tetraphenylborate salt, a phosphonium salt polymer formed by condensation of at least one dicarboxylic acid or dicarboxylic ester monomer with at least one diol monomer, at least one of the acid or ester monomers including a triarylphosphonium salt group, and a water-immiscible liquid; dispersing the organic phase in an aqueous phase containing a solid colloidal stabilizer; forming a suspension of small droplets of the organic phase in the aqueous phase by high shear agitation; removing the water-immiscible liquid from the small droplets, thereby forming a suspension of small solid particles in the aqueous phase; and separating and drying the solid particles, which are toner particles having a non-spherical shape.

24 Claims, No Drawings

METHOD FOR FORMING TONER PARTICLES HAVING CONTROLLED MORPHOLOGY AND CONTAINING A QUATERNARY AMMONIUM TETRAPHENYLBORATE AND A POLYMERIC PHOSPHONIUM SALT

CROSS-REFERENCE TO RELATED APPLICATION

This application is related to co-pending, commonly assigned application Ser. No. 09/814,899, filed Mar. 22, 2001 for METHOD FOR FORMING TONER PARTICLES HAVING CONTROLLED MORPHOLOGY AND CONTAINING QUATERNARY AMMONIUM TETRAPHENYLBORATE CHARGE CONTROL AGENTS.

FIELD OF THE INVENTION

The present invention relates to polymeric powders suitable for use as electrostatographic toners and, more particularly, to a method for forming electrostatographic toner particles comprising a quaternary ammonium tetraphenylborate salt and a polymeric phosphonium salt that operate to control the morphology of the toner particles.

BACKGROUND OF THE INVENTION

Electrostatic toner polymer particles are commonly prepared by a process referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a water-immiscible solvent. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131, the disclosures of which are incorporated herein by reference.

The shape of the toner particles has a bearing on electrostatic toner transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toners independently of pigment, binder, or charge agent choice in order to enhance the cleaning and transfer properties of the toner.

U.S. Pat. No. 5,283,151 is representative of the prior art in this field and described the use of carnauba wax to modify toner morphology. The method comprises the steps of dissolving carnauba wax in ethyl acetate heated to a temperature of at least 75° C. and cooling the solution, resulting in the precipitation of the wax in the form of very fine needles a few microns in length; recovering the wax needles and mixing them with a polymer material, a solvent, a charge control agent, and, optionally, a pigment to form an organic phase; dispersing the organic phase in an aqueous phase comprising a particulate stabilizer and homogenizing the mixture; and evaporating the solvent and washing and drying the resultant product.

This technique, however, requires the use of elevated temperature to dissolve the wax in the solvent, followed by cooling the solution to precipitate the wax. The wax does not stay in solution in ethyl acetate at ambient temperature, which makes scale-up of this method very difficult.

Tetraphenylborate quaternary salts have been employed as charge control agents for electrophotographic toners. For example, U.S. Pat. Nos. 5,194,472 and 5,516,616 disclose quaternary ammonium salt charge control agents, including tetraphenylborates, that contain ester moieties. U.S. Pat. Nos. 5,075,190 and 5,041,625 disclose mono- and bis-pyridinium tetraphenylborate charge control agents, and U.S. Pat. No. 5,482,741 describes a process for absorbing a charge control agent such as potassium tetraphenylborate onto flow aid particles. Also, JP 91-41021 discloses an image-forming method using a toner containing various kinds of tetraarylborates as charge control-agents.

Polymeric phosphonium salts are known as components of xerographic or electrostatic toner particles. For example, both U.S. Pat. Nos. 4,837,394 and 4,855,396 both disclose toner particles in which quaternary phosphonium salt moieties are covalently bound to polyesters.

Thus, although both tetraphenylborate quaternary ammonium salts and polymeric phosphonium salts have been individually employed in toner particles, their use in combination as shape control agents in the limited coalescence process for making toner particles is not known.

SUMMARY OF THE INVENTION

The present invention is directed to a process for forming non-spherical toner particles by limited coalescence comprises: forming an organic phase comprising a polymeric material, a pigment, a quaternary ammonium tetraphenylborate salt, a phosphonium salt polymer formed by condensation of at least one dicarboxylic acid or dicarboxylic ester monomer with at least one diol monomer, at least one of the acid or ester monomers including a triarylphosphonium salt group, and a water-immiscible liquid; dispersing the organic phase in an aqueous phase containing a solid colloidal stabilizer; forming a suspension of small droplets of the organic phase in the aqueous phase by high shear agitation; removing the water-immiscible liquid from the small droplets, thereby forming a suspension of small solid particles in the aqueous phase; and separating and drying the solid particles, which are toner particles having a non-spherical shape.

DETAILED DESCRIPTION OF THE INVENTION

The present invention relates to a method for the preparation of polymeric powders suitable for use as electrostatographic toner, and more particularly, to a method for preparation of toner particles of controlled shape and charge in which certain quaternary ammonium tetraphenylborate salts, in combination with a phosphonium salt polymer formed by condensation of at least one dicarboxylic acid or dicarboxylic ester monomer with at least one diol monomer, wherein at least one of the acid or ester monomers includes a triarylphosphonium salt group, are introduced into the organic phase of a limited coalescence process to control the morphology of the particles and to function as charge control agents.

In accordance with the present invention, the pigment can be provided as a dispersion, prepared by conventional techniques as, for example, media milling, melt dispersion and the like. The pigment dispersion, polymeric material, quaternary ammonium tetraborate salt, water-immiscible solvent, and, optionally, an additional charge control agent are combined to form an organic phase in which the pigment concentration ranges from about 1 to about 40 weight percent, preferably, about 4 to about 20 weight percent, based upon the total weight of solids. The optional charge control agent is employed in an amount up to about 10 weight percent, preferably about 0.2 to about 5 weight percent, based on the total weight of solids. Suitable charge control agents are disclosed, for example, in U.S. Pat. Nos. 3,893,935, 4,323,634, and 4,079,014, and British Patent No. 1,420,839.

The solvents chosen for use in the organic phase steps may be selected from among any of the well-known solvents capable of dissolving polymers of the type employed herein. Typical of the solvents chosen for this purpose are dichloromethane, ethyl acetate, methyl ethyl ketone, and the like.

The organic phase is permitted to stir, typically overnight, and then dispersed in an aqueous phase comprising a particulate stabilizer and, optionally, a promoter. The aqueous phase may have a pH of about 2 to about 7 but preferably is buffered to a pH of about 4.

The particulate stabilizer may be selected from silicon dioxide or from highly cross-linked polymeric latex materials of the type described in the previously mentioned U.S. Pat. No. 4,965,131. Silicon dioxide is preferred and is generally used in an amount ranging from about 1 to about 15 weight percent, based on the total solids employed. The size and concentration of the stabilizer particles determine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxymethyl cellulose, tetramethyl-ammonium hydroxide or chloride, 2-(diethylamino)ethyl methacrylate, water-soluble complex resinous amine condensation products of ethylene oxide, urea and formaldehyde, and polyethyleneimine. Also effective for this purpose are gelatin, casein, albumin, gluten and the like, or non-ionic materials such as methoxycellulose. The promoter is generally used in an amount from about 0.2 to about 0.6 parts per 100 parts of aqueous solution.

Various additives generally present in electrostatographic toner may be added to the polymer prior to dissolution in the solvent or in the dissolution step itself, such as waxes and lubricants.

The mixture of organic and aqueous phases is subjected to homogenization by high shear agitation, typically at ambient temperature, whereby the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume may range from 1:1 to approximately 9:1. This indicates that the organic phase is typically present in an amount from about 10% to 50% of the total homogenized volume. Following the homogenization treatment, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins, such as polytetrafluoroethylene and polytrifluorochloroethylene; polyamides, such as poly(hexamethylene adipamide), poly(hexamethylene sebacamide), and polycaprolactam; acrylic resins, such as poly(methyl methacrylate), poly(methyl acrylate), poly (ethyl methacrylate), styrene-methyl methacrylate copolymers, ethylene-methylacrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins, ethylene-allyl alcohol copolymers, and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as TiO2, carbon black and the like. Typical of the phthalocyanine pigments are copper phthalocyanine, a monochlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to give a content thereof in the toner from about 1 to about 40 weight percent, preferably about 4 to about 20 weight percent, based upon the weight of the toner.

Quaternary ammonium tetraphenylborate salts useful in the practice of the present invention are represented by the general formulas (I), (II), and (III), as described below:

(I)

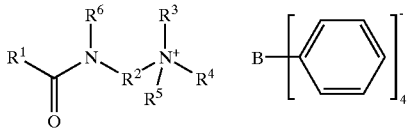

where $R^1$ represents a substituted or unsubstituted alkyl or aryl group; $R^2$ represents an alkylene or arylene group; $R^3$, $R^4$, and $R^5$ each independently represents a substituted or unsubstituted alkyl group; and $R^3$ and $R^4$ taken together may represent a cyclic ring system; and $R_6$ represents hydrogen or an alkyl group. Examples of $R^1$ include methyl, ethyl, n-propyl, n-butyl, n-hexyl, undecyl, heptadecyl, phenyl, 4-methylphenyl, 4-t-butylphenyl, and the like. Examples of $R^2$ include ethylene, 1,3-propylene, 1,4-butylene, hexamethylene, p-phenylene, and the like. Examples of $R^3$, $R^4$, and $R^5$ include methyl, ethyl, propyl, octadecyl, benzyl, and the like, and $R^3$ and $R^4$ taken together may be 1,4-butylene, 1,5-pentylene, and the like. Examples of $R^6$ include hydrogen, methyl, ethyl, n-propyl, n-butyl, octadecyl, benzyl, and the like. Preferably, $R^1$ is undecyl, $R^2$ is 1,3-propylene, $R^3$ is methyl, $R^4$ is methyl, $R^5$ is benzyl and $R^6$ is hydrogen.

(II)

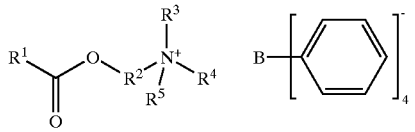

where $R^1$ represents a substituted or unsubstituted alkyl or aryl group; $R^2$ represents an alkylene or arylene group; $R^3$, $R^4$ and $R^5$ each independently represents a substituted or unsubstituted alkyl group; and $R^3$ and $R^4$ taken together may represent a cyclic ring system. Examples of $R^1$ include methyl, ethyl, n-propyl, n-butyl, n-hexyl, n-undecyl, n-heptadecyl, phenyl, 4-methylphenyl, 4-t-butylphenyl, and the like. Examples of $R^2$ include ethylene, 1,3-propylene, 1,4-butylene, hexamethylene, p-phenylene, and the like. Examples of $R^3$, $R^4$ and $R^5$ include methyl, ethyl, propyl, octadecyl, benzyl, and the like, and $R^3$ and $R^4$ taken together may be 1,4-butylene, 1,5-pentylene, and the like. Preferably, $R^1$ is undecyl or phenyl, $R^2$ is 1,3-propylene, $R^3$ is methyl, $R^4$ is methyl, and $R^5$ is benzyl.

(III)

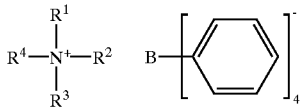

where $R^1$, $R^2$, $R^3$ and $R^4$ each independently represents an alkyl or substituted alkyl group, and $R^1$ and $R^2$ taken together may represent a cyclic ring system. Examples of $R^1$, $R^2$, $R^3$ and $R^4$include methyl, ethyl, propyl, isopropyl, n-butyl, t-butyl, pentyl, hexyl, 2-ethylhexyl, heptyl, octyl, decyl, octadecyl, benzyl, 2-naphthylmethyl, and the like. Examples of $R^1$ and $R^2$ taken together include 1,4-butylene, 1,5-pentylene, and the like. Preferably, $R^1$ and $R^2$ are methyl, $R^3$ is octadecyl, and $R^4$ is 2-naphthylmethyl.

Tables 1 and 2 contain structures of representative compounds of the general formulas (I) and (III), respectively. Table 3 lists structures of representative compounds of the general formula (III).

TABLE 1

I

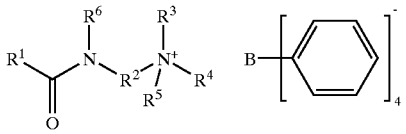

| Compound | $R^1$ | $R^2$ | $R^3$ | $R^4$ | $R^5$ | $R^6$ |
|---|---|---|---|---|---|---|
| 1 | $C_{11}H_{23}$ | $CH_2CH_2CH_2$ | $CH_3$ | $CH_2C_6H_5$ | $CH_3$ | H |
| 2 | $C_{11}H_{23}$ | $CH_2CH_2CH_2$ | $CH_3$ | $CH_3$ | $CH_3$ | H |
| 3 | $C_5H_{11}$ | $CH_2CH_2CH_2$ | $CH_3$ | $CH_2C_6H_5$ | $CH_3$ | H |
| 4 | $C_{11}H_{23}$ | $CH_2CH_2$ | $CH_3$ | $CH_2C_6H_5$ | $CH_3$ | H |

TABLE 2

II

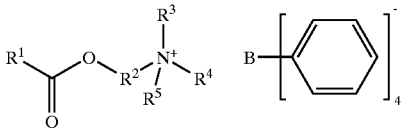

| Compound | $R^1$ | $R^2$ | $R^3$ | $R^4$ | $R^5$ |
|---|---|---|---|---|---|
| 5 | $C_{11}H_{23}$ | $CH_2CH_2$ | $CH_3$ | $CH_2C_6H_5$ | $CH_3$ |
| 6 | $C_{11}H_{23}$ | $CH_2CH_2$ | $CH_3$ | $CH_3$ | $CH_3$ |
| 7 | $C_{11}H_{23}$ | $CH_2CH_2CH_2$ | $CH_3$ | $CH_2C_6H_5$ | $CH_3$ |
| 8 | $C_6H_5$ | $CH_2CH_2CH_2$ | $CH_3$ | $CH_3$ | $CH_3$ |
| 9 | $C_6H_5$ | $CH_2CH_2CH_2$ | $CH_3$ | $CH_2C_6H_5$ | $CH_3$ |

TABLE 3

(III)

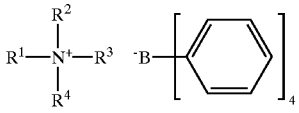

| Compound | $R^1$ | $R^2$ | $R^3$ | $R^4$ |
|---|---|---|---|---|
| 10 | $CH_3$ | $CH_3$ | $C_{18}H_{37}$ | $CH_2C_6H_5$ |
| 11 | $CH_3$ | $CH_3$ | $C_{18}H_{37}$ | $C_{18}H_{37}$ |
| 12 | $CH_3$ | $CH_3$ | $C_{18}H_{37}$ | 2-naphthyl-$CH_2$ |

In accordance with the present invention, the amount of quaternary ammonium tetraphenylborate salt in the toner particle composition comprises, preferably, about 0.1 to about 10 weight percent, more preferably, about 0.5 to about 5 weight percent of total solids.

Phosphonium salt polymers useful in the invention are condensation copolymers of the general formula (IV), formed by the condensation of at least one dicarboxylic acid or dicarboxylic ester monomer with at least one diol monomer, at least one of the acid or ester monomers including a triarylphosphonium salt group:

(IV)

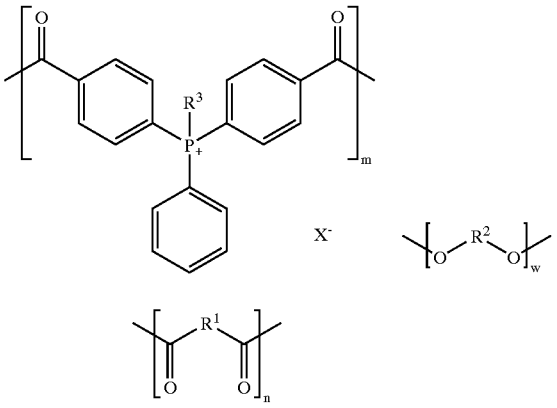

where $R^1$ represents a substituted or unsubstituted alkylene group, a substituted or unsubstituted 1,2-ethenyl group, or a substituted or unsubstituted arylene group; $R^2$ represents a substituted or unsubstituted alkylene group or a substituted or unsubstituted arylene group; and $R^3$ represents a substituted or unsubstituted alkyl group; $X^-$ represents an anion; m and n are mole percents totaling 100, based on total diacid or diester, where m has a value of 0.01 to 100; and —O—$R^2$—O— represents the radical of at least one diol monomer having a total mole percent, w, of 100, based on total diol.

Examples of $R^1$ include ethylene, 1,3-propylene, 1,4-butylene, p-phenylene, m-phenylene, 1,2-ethenyl, 2,6-naphthalenyl, and the like; $R^2$ is ethylene, 1,2-propylene, 1,4-butylene, 2,2-dimethyl-1,3-propylene, 1,4-cyclohexylenedimethylene, 2,2,4,4-tetramethyl-1,3-cyclobutylene, 4,4'-isopropylidenediphenylene(poly)oxyalkylene, p-phenylene(poly)oxyalkylene, and the like. The $X^-$ anion is tosylate, halide, tetraphenylborate, methosulfate, triflate, and the like. Preferably, $R^1$ is 1,2-ethenyl, $R^2$ is 4,4'-isopropylidenediphenylene(2.0) oxypropylene, $R^3$ is methyl, $X^-$ is tosylate, m is 10, n is 90, and w is 100.

The amount of triarylphosphonium salt polymer in the toner particle compositions of the present invention comprises, preferably, about 0.1 to about 10 weight percent, more preferably, about 0.5 to about 5 weight percent of total solids.

Synthesis Examples

Copolymerization of Methyl Bis(4-carbomethoxyphenyl) phenylphosphonium p-toluenesulfonate, Fumaric acid and Propoxylated(2.0)Bisphenol A (m=10, n=90, w=100, a+b=2.0)

Copolymerization of Methyl Bis(4-carbomethoxyphenyl)phenylphosphonium p-toluenesulfonate, Fumaric acid and Propoxylated (2.0) Bisphenol A ( m = 10, n = 90, w = 100, a + b = 2.0)

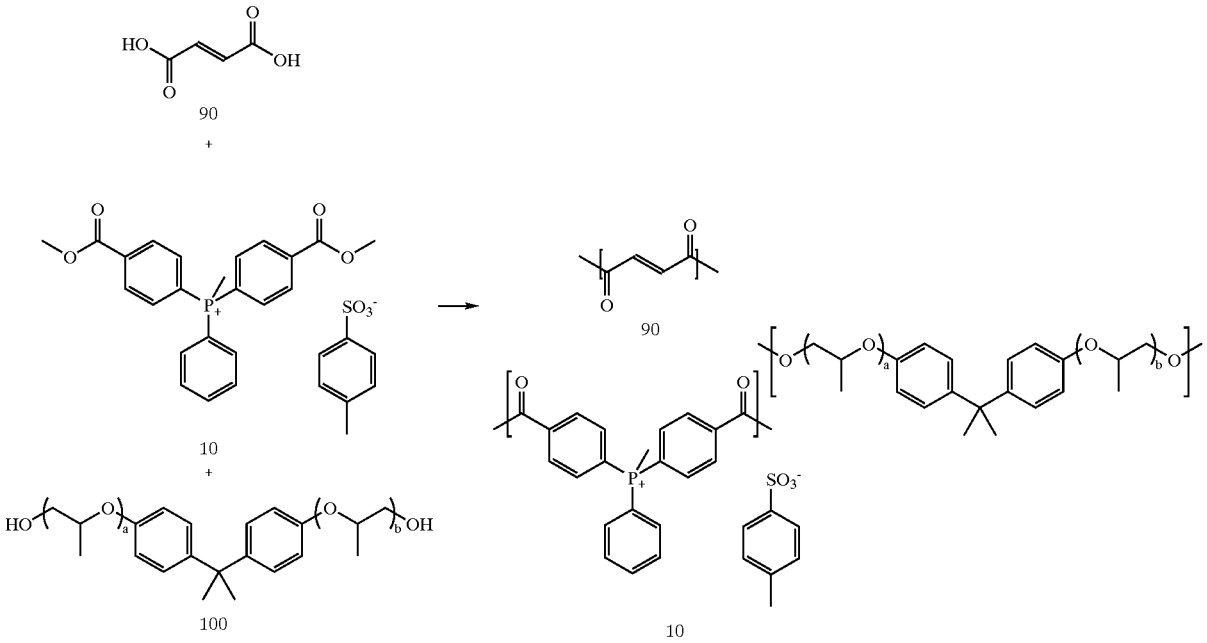

A mixture of 814.4 g (2.37 mol) of DIANOL 320™ propoxylated 2.0 Bisphenol A (available from Seppic Inc., Fairfield N.J.), 241.9 g (2.084 mol) of fumaric acid, 130.8 g (0.232 mol) of methyl bis(4-carbomethoxyphenyl) phenylphosphonium p-toluenesulfonate, and 1.00 g of FASCAT 4100™ catalyst (available from Atofina Chemicals, Inc., Philadelphia Pa.)was stirred and heated under nitrogen in a 225° C. salt bath for 6 hrs, then cooled. The resultant polymer, which is presumed to include the monomeric units in substantially the same molar ratio (m:n:w) as was employed in the feed mixture, had a Tg of 42.8 ° C. and an inherent viscosity in methylene chloride (0.25 g/dl, 25° C.) of 0.066 dl/g.

Preparation of N-(3-Dimethylaminopropyl) Lauramide

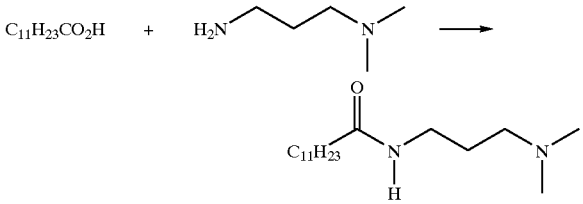

A mixture of 1000.0 g (5.0 mol) of lauric acid and 510.2 g (5.0 mol) of 3-dimethylaminopropylamine was placed in a 3-necked 2 liter flask equipped with a blade stirrer and Vigreaux column with takeoff head. The mixture was heated with stirring in an oil bath over a 2.42 hour period while gradually increasing the bath temperature to 219° C. and collecting the water condensate. The mixture was placed on oil pump vacuum for 15 min to remove any remaining water and cooled. The yield of product was 1346.4 g (94.7% of theory).

Preparation of N,N-Dimethyl-N-(3-lauramidopropyl)-N-benzylammonium Chloride

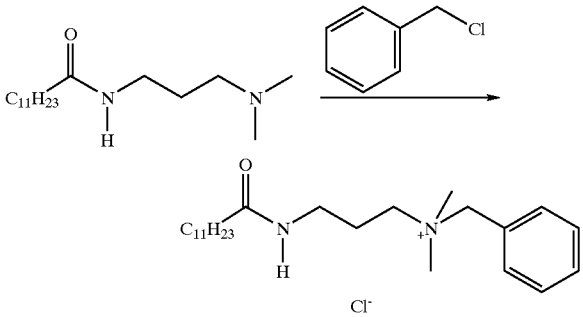

A solution of 116.38 g (0.409 mol) of N-(3-dimethylaminopropyl)lauramide and 51.79 g (0.409 mol) of benzyl chloride in 500 ml of acetone was stirred at room temperature for 48 hrs. The solution was concentrated to a viscous oil. The yield of product was 167.2 g (99.4% of theory).

Anal. Calcd. For $C_{24}H_{43}N_2OCl$: C, 70.1; H, 10.5; N, 6.8; Cl, 8.6; Found: C, 67.52; H, 10.73; N, 6.17; Cl, 8.17.

Preparation of N,N-Dimethyl-N-(3-lauramidopropyl)-N-benzylammonium Tetraphenylborate

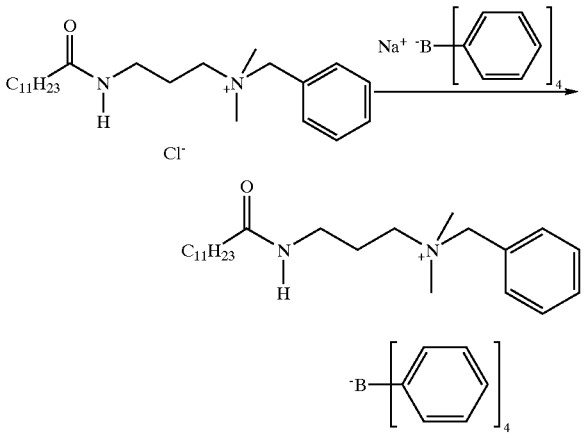

A solution of 1944.36 g (4.73 mol) of N,N-dimethyl-N-(3-lauramidopropyl)-N-benzylammonium chloride in 8 liters of water was added to a solution of 1618.84 g (4.73 mol) of sodium tetraphenylborate in 10 liters of water. The gummy solid that formed was dissolved in methylene chloride, and the resulting solution was dried over magnesium sulfate and concentrated. Ether was added to the residual oil, resulting in the formation of a solid that was collected and dried t o give 2273.5 g (69.2% of theory) of product; mp=112–118° C.

Anal. Calcd. for $C_{48}H_{63}N_2OB$: C, 83.0; H, 9.1; N, 4.0; Found: C, 82.60; H, 9.20; N, 3.95.

Preparation of N-(3-Lauramidopropyl)trimethylammonium Iodide

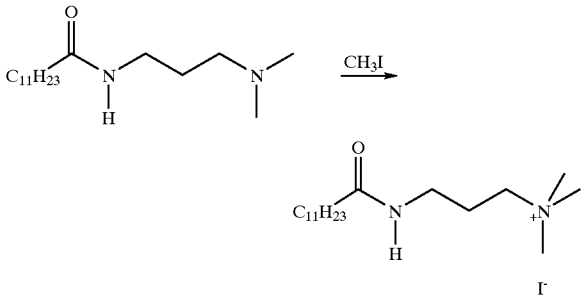

A solution of 30.0 g (0.105 mol) of N-(3-dimethylaminopropyl)lauramide, 15.0 g (0.105 mol) of methyl iodide, and 120 ml of acetone was prepared and cooled in a cold water bath to dissipate the heat of reaction. Within 10 mins, a white solid formed. The reaction mixture was allowed to stand for 5 hrs after removing the cooling bath. The solid was collected, washed with acetone and dried. The yield of product was 38.8 g (86.7% of theory).

Preparation of N-(3-Lauramidopropyl)trimethylammonium Tetraphenylborate

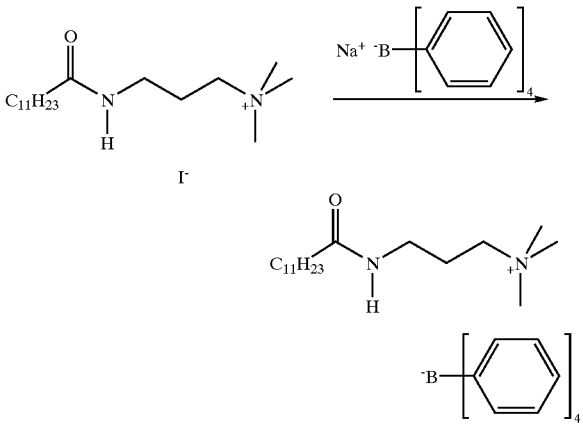

A solution of 38.8 g (0.091 mol) of N-(3-lauramidopropyl)trimethylammonium iodide in 150 ml of methanol and 31.15 g (0.091 mol) of sodium tetraphenylborate in 150 ml of water were combined with vigorous stirring. The resulting white precipitate was collected, washed with water, and recrystallized from a mixture of 600 ml of ethanol and 30 ml of acetonitrile. The solid was collected, washed with ethanol and dried. The yield of product was 46.2 g (82.1% of theory); mp=173–175° C.

Anal. $C_{42}H_{59}N_2OB$: C, 81.5; H, 9.6; N, 4.5; Found: C, 81.35; H, 9.73; N, 4.52.

Preparation of N,N-Dimethyl-N-octadecyl-N-benzylammonium Tetraphenylborate

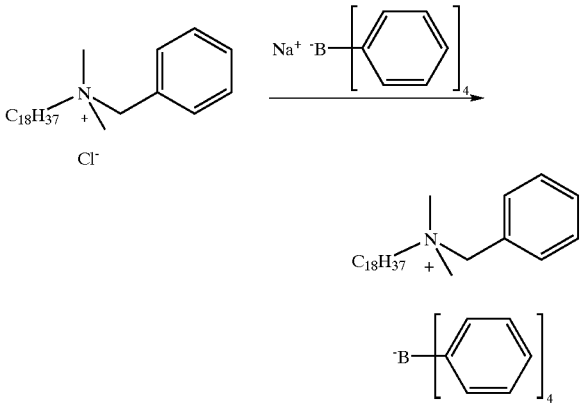

A solution of 42.42 g (0.10 mol) of N,N-dimethyl-N-octadecyl-N-benzylammonium chloride in 500 ml of water and a solution of 34.22 g (0.10 mol) of sodium tetraphenylborate in 150 ml of water were combined. The resulting white precipitate was collected and washed with ethanol. The crude product was recrystallized from 1500 ml of ethanol and 150 ml of acetonitrile, and the product was collected and dried. Yield: 58.0 g (81.9% of theory); mp=131.5–133° C.

Anal. Calcd. for $C_{51}H_{70}NB$: C, 86.5; H, 10.0; N, 2.0; B, 1.53; Found: C, 86.05; H, 10.14; N, 1.93; B, 1.69.

Preparation of N,N-Dimethyl-N-(2-Naphthylmethyl)-N-octadecylammonium Chloride

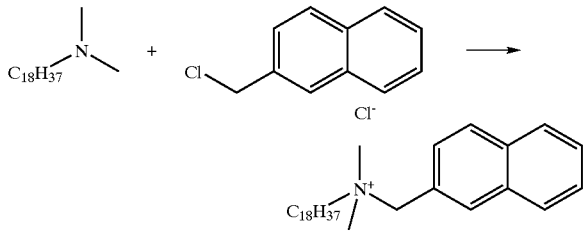

A mixture of 35.33 g (200 mmol) of 2-chloromethylnaphthalene, 59.51 g (200 mmol) of N,N-dimethyloctadecylamine, and 200 ml of acetonitrile was heated at reflux (complete solution at reflux) for 5 hrs, then cooled. The white solid that crystallized was collected, washed with ether, and dried to give 83.7 g of product (88.3% of theory); mp 84–87° C.

Preparation of N,N-Dimethyl-N-(2-Naphthylmethyl)-N-octadecylammonium Tetraphenylborate

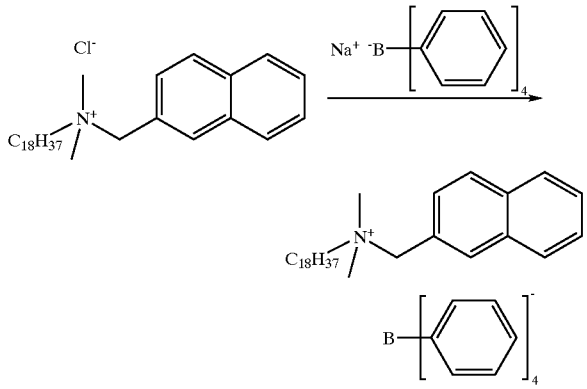

A solution of 47.42 g (100 mmol) of N,N-dimethyl-N-(2-naphthylmethyl)-N-octadecylammonium chloride in 100 ml of methanol was added, with stirring, to a solution of 34.23 g (100 mmol) of sodium tetraphenylborate in 150 ml of water. The white crystals that precipitated were collected, washed with water, and recrystallized from a mixture of 350 ml of ethanol and 800 ml of acetonitrile. The yield of product was 61.0 g (80.5% of theory); mp 168–170° C.

Anal. Calcd. For $C_{55}H_{72}NB$: C, 87.2; H, 9.6; N, 1.8; B, 1.43; Found: C, 87.84; H, 9.87; N, 2.04; B, 1.56.

Preparation of 2-Dimethylaminoethyl Laurate

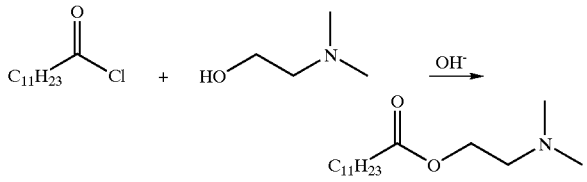

A solution of 87.51 g (400 mmol) of lauroyl chloride in 400 ml of methylene chloride was added to a solution of 35.66 g (400 mmol) of 2-dimethylaminoethanol and 16.00 g (400 mmol) of sodium hydroxide in 400 ml of water with rapid stirring over a 1 hour period. The mixture was stirred for another hour, and the organic layer was separated. The organic layer was washed twice with water, dried over magnesium sulfate, and concentrated. The NMR spectrum was consistent with the proposed structure.

Anal. Calcd. For $C_{16}H_{33}NO_2$: C, 70.22; H, 11.88; N, 3.95; Found: C, 70.47; H, 12.27; N, 4.00.

Preparation of N,N-Dimethyl-N-(2-lauroyloxyethyl)-N-benzylammonium Chloride

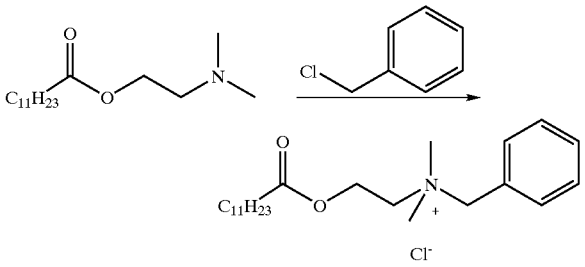

A solution of 39.55 g (146 mmol) of 2-(dimethylamino) ethyl laurate and 18.49 g (146 mmol) of benzyl chloride in 200 ml of acetone was stirred at room temperature overnight. The acetone was distilled off, and the crude material was used in the next step without further purification.

Preparation of N,N-Dimethyl-N-(2-lauroyloxyethyl)-N-benzylammonium Tetraphenylborate

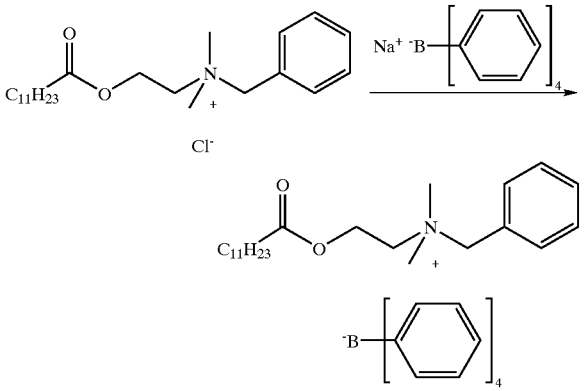

The crude N,N-dimethyl-N-(2-lauroyloxyethyl)-N-benzylammonium chloride, obtained as described in the preceding preparation was dissolved in 150 ml of methanol, and the resulting solution was poured into a filtered solution of 49.97 g (146 mmol) of sodium tetraphenylborate in 200 ml of water. The precipitate that formed was collected and dried to give 63.84 g of product; mp=133–5° C.

Anal. Calcd. For $C_{47}H^{60}NO_2B$: C, 82.80; H, 8.87; N, 2.05; B, 1.59; Found: C, 82.14; H, 8.90; N, 2.04; B, 1.61.

Comparative Example I

A media milled dispersion was prepared from a mixture of 9.0 g of a magenta pigment, Hostaperm Pink (manufactured by Hoechst Celanese), and 9.0 g of commercially available styrene-butyl acrylate polymer (PICCOTONER 1221™) in 670.0 g of ethyl acetate (13.0% solids of mixture). To 37.0 g of the above media milled dispersion were then added 20.2 g of KAO C™ binder and 26.2 g of ethyl acetate. This mixture, consisting of 17.5% pigment and 82.5% binder, provided the organic phase for an evaporative limited coalescence process. The organic phase was mixed with an aqueous phase comprising 85 ml of pH4 buffer containing 14.5 g of NALCO® 1060 and 3.2 ml of 10% poly(adipic acid-comethylaminoethanol). This mixture was then subjected to very high shear using a POLYTRON™, sold by Brinkman, followed by a Microfluidizer. The liquid phase was removed from the particles so formed by stirring overnight at room temperature in an open container. The particles were washed with 0.1N potassium hydroxide solution to remove the silica, then washed with water and dried. The toner particles were of the order of 4.2 $\mu$ volume average and entirely spherical in shape, as revealed by microscopic examination, with BET number of 0.90 $m^2/g$.

Comparative Example II

The procedure of Comparative Example I was repeated with the exception that 10.0% of a mixture of a cyan pigment, Bridged Aluminum Phthalocyanine and Copper Phthalocyanine pigments, manufactured by Eastman Kodak and BASF, respectively, replaced the Hostaperm Pink pigment. The resultant particles were spherical, and particle size was 4.0 $\mu$, with BET number of 0.60 $m^2/g$.

Comparative Example III

The procedure of Comparative Example I was repeated with the exception that the Hostaperm Pink pigment was replaced by 10.0% Pigment Yellow 180, manufactured by BASF. The resultant particles were spherical, and particle size was 3.6 $\mu$, with BET number of 0.95 $m^2/g$.

Comparative Example IV

The procedure of Comparative Example I was repeated with the exception that the Hostaperm Pink pigment was replaced by 8.0% carbon black pigment, BLACK PEARLS 280™, manufactured by Cabot. The resultant particles were completely spherical, and particle size was 4.9 $\mu$, with BET number of 0.50 $m^2/g$.

Example 1

To 37.0 g of the Hostaperm Pink media milled dispersion were added 19.7 g of KAO C™ binder, 0.25 g of Compound 1, 0.50 g of the copolymer of methyl bis(4-carbomethoxyphenyl)phenylphosphonium p-toluenesulfonate, fumaric acid, and propoxylated(2.0) bisphenol A, prepared as described above, and 26.2 g of ethyl acetate. This mixture, containing 17.5% pigment and 82.5% binder, comprised the organic phase in the evaporative limited coalescence process. The organic phase was mixed with an aqueous phase comprising 85 ml of pH4 buffer containing 14.5 g of NALCO® 1060 and 3.2 ml of 10% poly (adipic acid-comethylaminoethanol). This mixture was then subjected to very high shear using a POLYTRON™ sold by Brinkman, followed by a Microfluidizer. Upon exiting, the liquid phase was removed from the particles so formed by stirring overnight at room temperature in an open container. These particles were washed with 0.1N potassium hydroxide solution to remove the silica, then washed with water and dried. The toner particles, which contained 1.0 weight % of Compound 1, were of the order of 3.8 $\mu$ volume average and entirely non-spherical, with BET number of 2.82 $m^2/g$.

Example 2

The procedure of Example 1 was repeated with the exception that Compound 1 was replaced with Compound 2. The resultant particles, which contained 1.0 weight % of Compound 2, were entirely non-spherical, and particle size was 3.8 $\mu$, with BET number of 3.20 $m^2/g$.

Example 3

The procedure of Example 1 was repeated with the exception that magenta pigment was replaced with 10.0% BrAlPc/CuPc cyan pigment. The resultant non-spherical particles had a particle size of 3.8 $\mu$, with BET number of 2.14 $m^2/g$.

Example 4

The procedure of Example 2 was repeated with the exception that magenta pigment was replaced with 10.0% BrAlPc/CuPc cyan pigment. The resultant non-spherical particles had a particle size of 3.9 $\mu$, with BET number of 2.52 $m^2/g$.

Example 5

The procedure of Example 1 was repeated with the exception that magenta pigment was replaced with 10.0% Pigment Yellow 180. The resultant particles were completely non-spherical, and particle size was 4.4 $\mu$, with BET number of 1.75 $m^2/g$.

Example 6

The procedure of Example 2 was repeated with the exception that magenta pigment was replaced with 10.0% Pigment Yellow 180. The resultant particles were completely non-spherical, and particle size was 4.1 $\mu$, with BET number of 2.12 $m^2/g$.

Example 7

The procedure of Example 1 was repeated with the exception that magenta pigment was replaced with 8.0% carbon black (BLACK PEARLS 280™). The resultant non-spherical particles had a particle size of 3.5 $\mu$, with BET number of 2.18 $m^2/g$.

Example 8

The procedure of Example 2 was repeated with the exception that magenta pigment was replaced with 8.0% carbon black (BLACK PEARLS 280™). The resultant particles were completely non-spherical, and particle size was 4.1 $\mu$, with BET number of 2.29 $m^2/g$.

Example 9

To 21.1 g of the Pigment Yellow 180 media milled dispersion were added 21.8 g of KAO C™ binder, 0.25 g of Compound 5, 0.50 g of the copolymer of methyl bis(4-carbomethoxyphenyl)phenylphosphonium p-toluenesulfonate, fumaric acid, and propoxylated(2.0) bisphenol A, and 26.2 g of ethyl acetate. This mixture, containing 10.0% pigment and 90.0% binder, comprised the organic phase in the evaporative limited coalescence process. The organic phase was mixed with an aqueous phase comprising 85 ml of pH4 buffer containing 12.5 g of NALCO® 1060 and 2.7 ml of 10% poly (adipic acid-comethylaminoethanol). This mixture was then subjected to very high shear using a POLYTRON™ sold by Brinkman, followed by a Microfluidizer. Upon exiting, the liquid phase was removed from the particles so formed by stirring overnight at room temperature in an open container. The particles were washed with 0.1N potassium hydroxide solution to remove the silica, then washed with water and dried. The toner particles, which contained 1.0 weight % of Compound 5, were of the order of 3.6 $\mu$ volume average and entirely non-spherical, with BET number of 1.94 $m^2/g$.

Example 10

The procedure of Example 9 was repeated with the exception that Compound 5 was replaced with 0.25 g of Compound 6. The resultant particles, which contained 1.0 weight % of Compound 6, were completely non-spherical, and particle size was 3.7 $\mu$, with BET number of 2.42 $m^2/g$.

Example 11

The procedure of Example 9 was repeated with the exception that Compound 5 was replaced with 0.25 g of Compound 7. The resultant particles, which contained 1.0 weight % of Compound 7, were completely non-spherical, and particle size was 3.8 $\mu$, with BET number of 2.26 $m^2/g$.

Example 12

The procedure of Example 9 was repeated with the exception that Compound 5 was replaced with 0.25 g of Compound 9. The resultant particles, which contained 1.0 weight % of Compound 9, were completely non-spherical, and particle size was 3.5 $\mu$, with BET number of 1.95 $m^2/g$ Example 13

The procedure of Example 9 was repeated with the exception that Compound 5 was replaced with 0.25 g of Compound 8. The resultant particles, which contained 1.0 weight % of Compound 8, were completely non-spherical, and particle size was 4.0$\mu$, with BET number of 1.18 $m^2/g$.

Example 14

The procedure of Example 9 was repeated with the exception that Compound 5 was replaced with 0.25 g of Compound 12. The resultant particles, which contained 1.0 weight % of Compound 12, were completely non-spherical, and particle size was 3.7 $\mu$ with BET number of 1.36 $m^2/g$.

Example 15

The procedure of Example 9 was repeated with the exception that Compound 5 was replaced with 0.25 g of Compound 3. The resultant particles, which contained 1.0 weight % of Compound 3, were completely non-sphencal, and particle size was 3.5 $\mu$, with BET number of 1.61 $m^2/g$.

Example 16

The procedure of Example 9 was repeated with the exception that Compound 5 was replaced with 0.25 g of Compound 4. The resultant particles, which contained 1.0 weight % of Compound 4, were completely non-spherical, and particle size was 3.7 $\mu$, with BET number of 1.73 $m^2/g$.

BET Measurements

BET measurements of comparison toner particles and toner particles of the present invention were carried out using Single Point Monosorb® BET apparatus, from Quantachrome Corporation. The results, compiled in Table 4 below, demonstrate the control of toner morphology provided by the present invention. BET value of 1.00 $m^2/g$ or less is indicative of sphericity in shape of the toner particles, as is illustrated in Comparative Examples I, II, III, and IV. BET values were calculated according to P. Chenebault and A. Schrenkamper, "The Measurement of Small Surface Areas by the B.E.T. Adsorption Method", *The Journal of Physical Chemistry*, Volume 69, Number 7, July 1965, pages 2300–2305.

TABLE 4

| Example | Pigment Color | Particle size (μ) | BET Value ($m^2/g$) |
|---|---|---|---|
| Comparative I | magenta | 4.2 | 0.90 |
| Comparative II | cyan | 4.0 | 0.60 |
| Comparative III | yellow | 3.6 | 0.95 |
| Comparative IV | black | 4.9 | 0.50 |
| Example 1 | magenta | 3.8 | 2.82 |
| Example 2 | magenta | 3.8 | 3.20 |
| Example 3 | cyan | 3.8 | 2.14 |
| Example 4 | cyan | 3.9 | 2.52 |
| Example 5 | yellow | 4.4 | 1.75 |
| Example 6 | yellow | 4.1 | 2.12 |
| Example 7 | black | 3.5 | 2.18 |
| Example 8 | black | 4.1 | 2.29 |
| Example 9 | yellow | 3.6 | 1.94 |
| Example 10 | yellow | 3.7 | 2.42 |
| Example 11 | yellow | 3.8 | 2.26 |
| Example 12 | yellow | 3.5 | 1.95 |
| Example 13 | yellow | 4.0 | 1.18 |
| Example 14 | yellow | 3.7 | 1.36 |
| Example 15 | yellow | 3.5 | 1.61 |
| Example 16 | yellow | 3.7 | 1.73 |

As shown by examination of the BET measurements in Table 4 above, inclusion of at least one tetraphenylborate salt in magenta, cyan, yellow, and black toner particles formed in accordance with the present invention resulted in a substantial beneficial reduction in their sphericity characteristics relative to the corresponding Comparative particles I, II, III, and IV.

Reduction of the sphericity of toner particles resulting from the inclusion of a tetraphenylborate salt is disclosed in the co-pending, cross-referenced application Ser. No. 09/814,899, filed Nov. 22, 2000 for METHOD FOR FORMING TONER PARTICLES HAVING CONTROLLED MORPHOLOGY AND CONTAINING QUATERNARY AMMONIUM TETRAPHENYLBORATE CHARGE CONTROL AGENTS. The further inclusion of a phosphonium salt polymer in the toner composition, in accordance with the present invention, provides an additional desirable change in toner particle morphology, as reflected in further increases in the measured BET values resulting from the addition of the phosphonium salt polymer. This improvement can be detected by comparing the measurements for Examples 1–12 in Table 4 above with those of Examples 1–12 listed in Table 5 of the application entitled METHOD FOR FORMING TONER PARTICLES HAVING CONTROLLED MORPHOLOGY AND CONTAINING QUATERNARY AMMONIUM TETRAPHENYLBORATE CHARGE CONTROL AGENTS. The formulation of the two sets of examples are identical except for the inclusion of the phosphonium salt polymer in the set listed in Table 4 above, all of which show substantially higher BET values than the Table 5 set. This demonstrates the enhancing effect on particle morphology provided by the included phosphonium salt polymer compared with the inclusion of the quaternary ammonium tetraphenylborate alone.

Charge Control Properties

Charge control properties provided by tetraphenylborate quaternary salts in accordance with the present invention are tabulated in Table 5. The triboelectric charge of electrophotographic developers changes with life. This instability in charging level is one of the factors that require active process control systems in electrophotographic printers to maintain consistent print to print image density.

Developers with low charge/mass (Q/m) have good stability and provide the capability for improved electrostatic transfer and consequent higher densities. Q/m values are dependent on particle size; for toners of a particular composition, the smaller the particle, the higher the absolute Q/m value. It is desirable to lower the absolute Q/m of toner particles, an advantage that is realized by the present invention.

TABLE 5

| | | | New Developer 10BB | | Strip and Rebuild 10BB | |
|---|---|---|---|---|---|---|
| Example | Pigment Color | Particle Size (μ) | Q/m | % TC | Q/m | % TC |
| Comparative I | magenta | 4.2 | −74 | 6.0 | −93 | 6.0 |
| Comparative II | cyan | 4.0 | −156 | 5.0 | −175 | 5.2 |
| Comparative III | yellow | 3.6 | −151 | 5.3 | −178 | 5.4 |
| Comparative IV | black | 4.9 | −86 | 5.7 | −86 | 6.0 |
| Example 1 | magenta | 3.8 | −55 | 5.6 | −62 | 5.8 |
| Example 2 | magenta | 3.8 | −26 | 5.7 | −17 | 5.7 |
| Example 3 | cyan | 3.8 | −107 | 5.7 | −112 | 6.0 |
| Example 4 | cyan | 3.9 | −59 | 5.7 | −47 | 6.0 |
| Example 5 | yellow | 4.4 | −107 | 5.5 | −106 | 5.6 |
| Example 6 | yellow | 4.1 | −65 | 5.5 | −85 | 5.7 |
| Example 7 | black | 3.5 | −98 | 5.8 | −102 | 6.0 |
| Example 8 | black | 4.1 | −62 | 5.4 | −55 | 5.8 |
| Example 9 | yellow | 3.6 | −100 | 5.6 | −103 | 5.8 |
| Example 10 | yellow | 3.7 | −68 | 6.0 | −74 | 5.8 |
| Example 11 | yellow | 3.8 | −69 | 5.7 | −69 | 6.1 |
| Example 12 | yellow | 3.5 | −99 | 5.6 | −105 | 5.9 |
| Example 13 | yellow | 4.0 | −115 | 5.6 | −129 | 6.1 |
| Example 14 | yellow | 3.7 | −99 | 5.9 | −124 | 5.3 |
| Example 15 | yellow | 3.5 | −106 | 5.6 | −119 | 6.0 |
| Example 16 | yellow | 3.7 | −99 | 5.6 | −127 | 5.4 |

Measurement of the charge/mass (Q/m) characteristics of the toner particles listed in Table 5 above were made using the "Bottle Brush" apparatus, as described in U.S. Pat. No. 5,405,727, the disclosure of which is incorporated herein by reference. The toners listed were tested for tribocharging by the following procedure:

Two-component developers are prepared at 6% by weight toner concentration. The carrier is obtained from PowderTech Corp., and comprises a permanently magnetized strontium ferrite core coated with 2% by weight of silicone resin. Four-gram samples of each developer are weighed into vials, which are subjected to 10 minutes of exercise on the Bottle Brush apparatus. The charge per mass (Q/m) of the developers is measured on a MECCA device comprising metal plates spaced 1 cm apart by insulating pegs, with a 60 Hz magnetic coil under the bottom plate. The bottom plate is biased to −2000V; the upper plate is connected to a coulombmeter; the toner deposit collected on the upper plate is weighed and Q/m is calculated as the ratio of the measured charge divided by the weight of toner developed. Table 5 lists the values so obtained as "New Developer 10BB" Q/m. The test comprises mounting the sample vial on top of a magnetic brush with an internal rotating magnetic core operating at 2000 rpm for 10 minutes. The magnetic core consists of 12 magnetic poles arranged in an alternating north, south fashion.

The vial is subsequently placed on the Bottle Brush apparatus and exercised for an additional 50 minutes. After this additional 50 minutes exercising, the developer is stripped of all toner and rebuilt with fresh toner at 6% TC, and Q/m is measured as described above, the results being entered in the column captioned "Strip and Rebuild 10BB."

As shown by examination of the Q/m measurements in Table 5 above, inclusion of at least one tetraphenylborate salt in magenta, cyan, yellow, and black toner particles formed in accordance with the present invention provides, in addition to the already discussed desirable effect on particle shape, a substantial beneficial reduction in the absolute Q/m of toner particles, in particular, cyan and yellow toners, relative to Comparative particles II and III.

Reduction of the absolute Q/m values of toner particles resulting from the inclusion of a tetraphenylborate salt is also disclosed in the application entitled METHOD FOR FORMING TONER PARTICLES HAVING CONTROLLED MORPHOLOGY AND CONTAINING QUATERNARY AMMONIUM TETRAPHENYLBORATE CHARGE CONTROL AGENTS. The further inclusion of a phosphonium salt copolymer in the toner composition, in accordance with the present invention, typically provides an additional desirable reduction in absolute Q/m values of the toner particles. This improvement can be detected by comparing the measurements for Examples 1–12 in Table 5 above with those of Examples 1–12 listed in Table 6 of the application entitled METHOD FOR FORMING TONER PARTICLES HAVING CONTROLLED MORPHOLOGY AND CONTAINING QUATERNARY AMMONIUM TETRAPHENYLBORATE CHARGE CONTROL AGENTS. The formulation of the two sets of examples are identical except for the inclusion of the phosphonium salt polymer in the set listed in Table 5 above, most of which show substantially lower absolute Q/m values than the Table 6 set. This demonstrates the additional improvement in toner particle performance provided by the included phosphonium salt polymer compared with the inclusion of the quaternary ammonium tetraphenylborate alone.

The invention has been described in detail with particular reference to certain preferred embodiments thereof, but it is under stood that variations and modifications can be effected within the spirit and scope of the invention, which is defined by the claims that follow.

What is claimed is:

1. A process for forming non-spherical toner particles by limited coalescence, said process comprising:

forming an organic phase comprising a polymeric material, a pigment, a quaternary ammonium tetraphenylborate salt, a phosphonium salt polymer formed by condensation of at least one dicarboxylic acid or dicarboxylic ester monomer with at least one diol monomer, at least one of said acid or ester monomers including a triarylphosphonium salt group, and a water-immiscible liquid;

dispersing said organic phase in an aqueous phase containing a solid colloidal stabilizer;

forming a suspension of small droplets of said organic phase in said aqueous phase by high shear agitation;

removing said water-immiscible liquid from said small droplets, thereby forming a suspension of small solid particles in said aqueous phase; and separating said solid particles from said aqueous phase and drying said particles, thereby forming toner particles having a non-spherical shape.

2. The process of claim 1 wherein said quaternary ammonium tetraphenyl-borate salt is selected from the group consisting of salts represented by the general formulas (I), (II), and (III), and mixtures thereof:

(I)

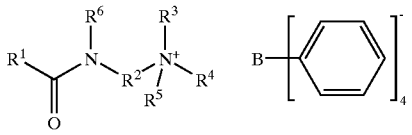

wherein $R^1$ represents a substituted or unsubstituted alkyl or aryl group; $R^2$ represents an alkylene or arylene group; $R_3$, $R_4$, and $R^5$ independently represent a substituted or unsubstituted alkyl group, and $R^3$ and $R^4$ taken together may represent a cyclic ring system; and $R^6$ represents hydrogen or an alkyl group;

(II)

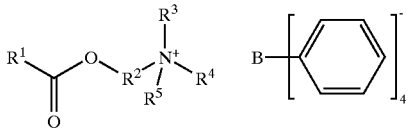

wherein $R^1$ represents a substituted or unsubstituted alkyl or aryl group; $R^2$ represents an alkylene or arylene group; $R^3$, $R^4$ and $R^5$ each independently represents a substituted or unsubstituted alkyl group; and $R^3$ and $R^4$ taken together may represent a cyclic ring system;

(III)

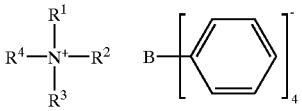

wherein $R^1$, $R^2$, $R^3$ and $R^4$ each independently represents an alkyl or substituted alkyl group, and $R^1$ and $R^2$ taken together may represent a cyclic ring system.

3. The process of claim 2 wherein, in general formula (I), $R^1$ is selected from the group consisting of methyl, ethyl, n-propyl, n-butyl, n-hexyl, n-undecyl, n-heptadecyl, phenyl, 4-methylphenyl, and 4-t-butylphenyl; $R_2$ is selected from the group consisting of ethylene, 1,3-propylene, 1,4-butylene, hexamethylene, and p-phenylene; $R^3$, $R^4$, and $R^5$ are each independently selected from the group consisting of methyl, ethyl, propyl, octadecyl, and benzyl, and $R^3$ and $R^4$ taken together may be 1,4-butylene or 1,5-pentylene, and $R^6$ is selected from the group consisting of hydrogen, methyl, ethyl, n-propyl, n-butyl, octadecyl, and benzyl.

4. The process of claim 3 wherein $R^1$ is n-undecyl, $R^2$ is 1,3-propylene, $R^3$ and $R_4$ are each methyl, $R^5$ is benzyl, and $R^6$ is hydrogen.

5. The process of claim 2 wherein, in general formula (II), $R^1$ is selected from the group consisting of methyl, ethyl, n-propyl, n-butyl, n-hexyl, n-undecyl, n-heptadecyl, phenyl, 4-methylphenyl, and 4-t-butylphenyl; $R^2$ is selected from the group consisting of ethylene, 1,3-propylene, 1,4-butylene, hexamethylene, and p-phenylene; $R^3$, $R^4$ and $R^5$ are each independently selected from the group consisting of methyl, ethyl, propyl, octadecyl, and benzyl, and and $R^3$ and $R^4$ taken together may be 1,4-butylene or 1,5-pentylene.

6. The process of claim 5 wherein $R^1$ is n-undecyl or phenyl, $R^2$ is 1,3are each methyl, and $R^5$ is benzyl.

7. The process of claim 2 wherein, in general formula (III), $R^1$, $R^2$, $R^3$ and $R^4$ are each independently selected from the group consisting of methyl, ethyl, propyl, isopropyl, n-butyl, t-butyl, pentyl, hexyl, 2-ethylhexyl, heptyl, octyl, decyl, octadecyl, benzyl, and 2-naphthylmethyl, and $R^1$ and $R^2$ taken together may be 1,4-butylene or 1,5-pentylene.

8. The process of claim 7 wherein $R^1$ and $R^2$ are each methyl, $R^3$ is octadecyl, and $R^4$ is 2-naphthylmethyl.

9. The process of claim 1 wherein said quaternary ammonium tetraphenyl-borate salt is selected from the group of salts listed in Tables 1, 2, and 3 following.

TABLE 1

I

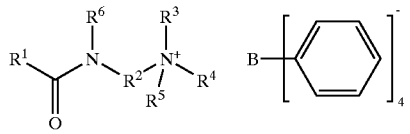

| Compound | $R^1$ | $R^2$ | $R^3$ | $R^4$ | $R^5$ | $R^6$ |
|---|---|---|---|---|---|---|
| 1 | $C_{11}H_{23}$ | $CH_2CH_2CH_2$ | $CH_3$ | $CH_2C_6H_5$ | $CH_3$ | H |
| 2 | $C_{11}H_{23}$ | $CH_2CH_2CH_2$ | $CH_3$ | $CH_3$ | $CH_3$ | H |
| 3 | $C_5H_{11}$ | $CH_2CH_2CH_2$ | $CH_3$ | $CH_2C_6H_5$ | $CH_3$ | H |
| 4 | $C_{11}H_{23}$ | $CH_2CH_2$ | $CH_3$ | $CH_2C_6H_5$ | $CH_3$ | H |

TABLE 2

II

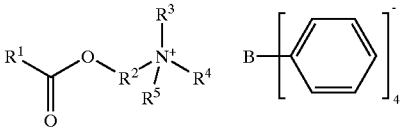

| Compound | $R^1$ | $R^2$ | $R^3$ | $R^4$ | $R^5$ |
|---|---|---|---|---|---|
| 5 | $C_{11}H_{23}$ | $CH_2CH_2$ | $CH_3$ | $CH_2C_6H_5$ | $CH_3$ |
| 6 | $C_{11}H_{23}$ | $CH_2CH_2$ | $CH_3$ | $CH_3$ | $CH_3$ |
| 7 | $C_{11}H_{23}$ | $CH_2CH_2CH_2$ | $CH_3$ | $CH_2C_6H_5$ | $CH_3$ |
| 8 | $C_6H_5$ | $CH_2CH_2CH_2$ | $CH_3$ | $CH_3$ | $CH_3$ |
| 9 | $C_6H_5$ | $CH_2CH_2CH_2$ | $CH_3$ | $CH_2C_6H_5$ | $CH_3$ |

TABLE 3

(III)

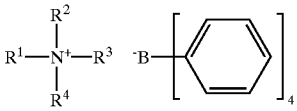

| Compound | $R^1$ | $R^2$ | $R^3$ | $R^4$ |
|---|---|---|---|---|
| 10 | $CH_3$ | $CH_3$ | $C_{18}H_{37}$ | $CH_2C_6H_5$ |
| 11 | $CH_3$ | $CH_3$ | $C_{18}H_{37}$ | $C_{18}H_{37}$ |
| 12 | $CH_3$ | $CH_3$ | $C_{18}H_{37}$ | 2-naphthyl-$CH_2$ |

and mixtures of said salts.

10. The process of claim 1 wherein said quaternary ammonium tetraphenylborate salt comprises about 0.1 to about 10 weight percent of total solids.

11. The process of claim 10 wherein said quaternary ammonium tetraphenylborate salt comprises about 0.5 to about 5 weight percent of total solids.

12. The process of claim 1 wherein said pigment comprises a dispersion.

13. The process of claim 1 wherein said water-immiscible liquid is selected from the group consisting of dichloromethane, ethyl acetate, methyl ethyl ketone, and mixtures thereof.

14. The process of claim 1 wherein said solid colloidal stabilizer comprises silicon dioxide.

15. The process of claim 1 wherein said aqueous phase has a pH of about 2 to about 7.

16. The process of claim 15 wherein said aqueous phase has a pH buffered to about 4.

17. The process of claim 1 wherein said phosphonium salt polymer is a condensation polymer of at least one dicarboxylic acid or dicarboxylic ester monomer with at least one diol monomer, at least one said acid or ester monomer including a triarylphosphonium salt group, said polymer having the general formula (IV)

(IV)

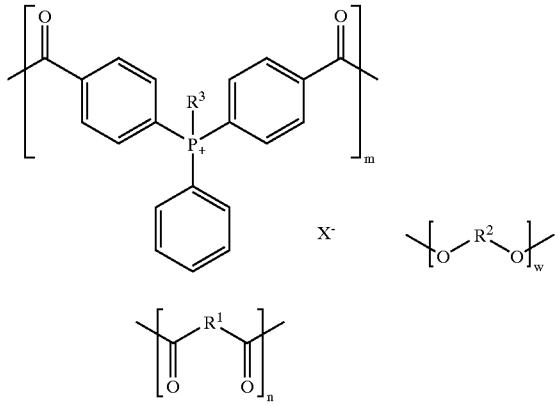

wherein $R^1$ represents a substituted or unsubstituted alkylene group, a substituted or unsubstituted 1,2-ethenyl group, or a substituted or unsubstituted arylene group; $R_2$ represents a substituted or unsubstituted alkylene group or a substituted or unsubstituted arylene group; and $R^3$ represents a substituted or unsubstituted alkyl group; $X^-$ represents an anion; m and n are mole percents totaling 100, based on total diacid or diester, m having a value of 0.01 to 100; and —O—$R^2$—O— represents the radical of at least one diol monomer having a total mole percent, w, of 100, based on total diol.

18. The process of claim 17 wherein $R^1$ is selected from the group consisting of ethylene, 1,3-propylene, 1,4-butylene, p-phenylene, m-phenylene, 1,2-ethenyl, and 2,6-naphthalenyl.

19. The process of claim 17 wherein $R^2$ is is selected from the group consisting of ethylene, 1,2-propylene, 1,4-butylene, 2,2-dimethyl-1,3-propylene, 1,4-cyclohexylenedimethylene, 2,2,4,4-tetramethyl-1,3-cyclobutylene, 4,4'-isopropylidenediphenylenepolyoxyalkylene, and p-phenylenepolyoxyalkylene.

20. The process of claim 17 wherein $X^-$ is selected from the group consisting of tosylate, halide, tetraphenylborate, methosulfate, and triflate.

21. The process of claim 17 wherein $R^1$ is 1,2-ethenyl, $R^2$ is 4,4'-isopropylidenediphenylene(2.0)oxypropylene, $R^3$ is methyl, and $X^-$ is tosylate.

22. The process of claim 17 wherein m is 10, n is 90, and w is 100.

23. The process of claim 1 wherein said phosphonium salt polymer comprises about 0.1 to about 10 weight percent of total solids.

24. The process of claim 23 wherein said phosphonium salt polymer comprises about 0.5 to about 5 weight percent of total solids.

* * * * *